US009205527B2

(12) United States Patent
Xu et al.

(10) Patent No.: US 9,205,527 B2
(45) Date of Patent: Dec. 8, 2015

(54) IN-SITU MONITORING SYSTEM WITH MONITORING OF ELONGATED REGION

(71) Applicant: Applied Materials, Inc., Santa Clara, CA (US)

(72) Inventors: Kun Xu, Sunol, CA (US); Shih-Haur Shen, Sunnyvale, CA (US); Tzu-Yu Liu, San Jose, CA (US); Ingemar Carlsson, Milpitas, CA (US); Hassan G. Iravani, San Jose, CA (US); Boguslaw A. Swedek, Cupertino, CA (US); Wen-Chiang Tu, Mountain View, CA (US); Doyle E. Bennett, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 192 days.

(21) Appl. No.: 13/791,694

(22) Filed: Mar. 8, 2013

(65) Prior Publication Data

US 2014/0127971 A1 May 8, 2014

Related U.S. Application Data

(60) Provisional application No. 61/724,218, filed on Nov. 8, 2012.

(51) Int. Cl.

| | |
|---|---|
| ***B24B 37/013*** | (2012.01) |
| ***B24B 37/04*** | (2012.01) |
| ***B24B 7/22*** | (2006.01) |

(52) U.S. Cl.
CPC ..... *B24B 37/013* (2013.01); *B24B 7/228* (2013.01); *B24B 37/048* (2013.01)

(58) Field of Classification Search
CPC ..... B24B 1/00; B24B 37/042; B24B 37/048; B24B 49/00; B24B 49/003; B24B 49/02; B24B 49/03; B24B 49/04; B24B 49/105
USPC ..... 451/5, 6, 8, 11, 41, 285–290
See application file for complete search history.

(56) References Cited

U.S. PATENT DOCUMENTS

| | | | | |
|---|---|---|---|---|
| 6,399,501 | B2 | 6/2002 | Birang et al. | |
| 6,924,641 | B1 | 8/2005 | Hanawa et al. | |
| 7,008,296 | B2 | 3/2006 | Swedek et al. | |
| 7,112,960 | B2 | 9/2006 | Miller et al. | |
| 7,113,257 | B2 * | 9/2006 | Brinkhof et al. | 355/53 |
| 8,284,560 | B2 | 10/2012 | Iravani et al. | |
| 2011/0189925 | A1 | 8/2011 | Iravani et al. | |
| 2012/0276661 | A1 | 11/2012 | Iravani et al. | |

* cited by examiner

*Primary Examiner* — Maurina Rachuba
(74) *Attorney, Agent, or Firm* — Fish & Richardson P.C.

(57) ABSTRACT

A method of chemical mechanical polishing a substrate includes polishing a layer on the substrate at a polishing station, monitoring the layer during polishing at the polishing station with an in-situ monitoring system, the in-situ monitoring system monitoring an elongated region and generating a measured signal, computing an angle between a primary axis of the elongated region and a tangent to an edge of the substrate, modifying the measured signal based on the angle to generate a modified signal, and at least one of detecting a polishing endpoint or modifying a polishing parameter based on the modified signal.

19 Claims, 5 Drawing Sheets

IN-SITU MONITORING SYSTEM WITH MONITORING OF ELONGATED REGION

CROSS-REFERENCE TO RELATED APPLICATIONS

This application claims priority to U.S. Provisional Application Ser. No. 61/724,218, filed Nov. 8, 2012, the entire disclosure of which is incorporated by reference.

TECHNICAL FIELD

The present disclosure relates to in-situ monitoring of an elongated region during chemical mechanical polishing of a substrate.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization may be used to planarize the substrate surface for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. A polishing liquid, such as slurry with abrasive particles, is supplied to the surface of the polishing pad.

During semiconductor processing, it may be important to determine one or more characteristics of the substrate or layers on the substrate. For example, it may be important to know the thickness of a conductive layer during a CMP process, so that the process may be terminated at the correct time. A number of methods may be used to determine substrate characteristics. For example, optical sensors may be used for in-situ monitoring of a substrate during chemical mechanical polishing. Alternately (or in addition), an eddy current sensing system may be used to induce eddy currents in a conductive region on the substrate to determine parameters such as the local thickness of the conductive region.

SUMMARY

An in-situ monitoring system that monitors an elongated region can provide improved signal strength at the substrate edge. However, if the relative angle between the region and the substrate edge changes over time, e.g., due to sweep of the carrier head, significant noise can be introduced into the portion of the signal generated by the monitoring system that corresponds to the substrate edge. By calculating the angle and feeding the data into a controller, this noise can be significantly reduced.

In one aspect, a method of chemical mechanical polishing a substrate includes polishing a layer on the substrate at a polishing station, monitoring the layer during polishing at the polishing station with an in-situ monitoring system, the in-situ monitoring system monitoring an elongated region and generating a measured signal, computing an angle between a primary axis of the elongated region and a tangent to an edge of the substrate, modifying the measured signal based on the angle to generate a modified signal, and at least one of detecting a polishing endpoint or modifying a polishing parameter based on the modified signal.

In another aspect, a method of chemical mechanical polishing a substrate includes polishing a layer on the substrate at a polishing station, monitoring the layer during polishing at the polishing station with an in-situ monitoring system, the in-situ monitoring system including an anisotropic sensor and generating a measured signal, computing an angle between a primary axis of the anisotropic sensor and a tangent to an edge of the substrate, modifying the measured signal based on the angle to generate a modified signal, and at least one of detecting a polishing endpoint or modifying a polishing parameter based on the modified signal.

In another aspect, a polishing system includes a carrier to hold a substrate, a support for a polishing surface, an in-situ monitoring system having a sensor, the in-situ monitoring system configured to monitor an elongated region and generate a measured signal, a motor to generate relative motion between the sensor and the substrate, and a controller configured to receive the measured signal from the in-situ monitoring system, compute an angle between a primary axis of the elongated region and a tangent to an edge of the substrate, modify the measured signal based on the angle to generate a modified signal, and at least one of detect a polishing endpoint or modify a polishing parameter based on the modified signal.

In another aspect, a polishing system includes a carrier to hold a substrate, a support for a polishing surface, an in-situ monitoring system having an anisotropic sensor configured to generate a measured signal, a motor to generate relative motion between the sensor and the substrate, and a controller configured to receive the measured signal from the in-situ monitoring system, compute an angle between a primary axis of the anisotropic sensor and a tangent to an edge of the substrate, modify the measured signal based on the angle to generate a modified signal, and at least one of detect a polishing endpoint or modify a polishing parameter based on the modified signal.

Implementations of any of the above aspects may include one or more of the following features. The angle may be the angle at a time when the elongated region or sensor is adjacent the edge of the substrate. Edge portions of the signal may be detected. Modifying the measured signal may include compressing or decompressing the edge portions. A compression ratio of the compressing or decompressing may be a function of the angle. The function of the angle may be such that the compression increases as the angle increases. Modifying the measured signal may include multiplying the signal by a gain factor. The gain factor may be a function of the angle. The function of the angle may be such that the gain factor decreases as the angle increases. The in-situ monitoring system may be an eddy current monitoring system having an elongated core.

Certain implementations can include one or more of the following advantages. An in-situ monitoring system, e.g., an eddy current monitoring system, can generate a signal as a sensor scans across the substrate. Noise in a portion of the signal that corresponds to the substrate edge can be reduced.

The signal can be used for endpoint control and/or closed-loop control of polishing parameters, e.g., carrier head pressure, thus providing improved within-wafer non-uniformity (WIWNU) and wafer-to-wafer non-uniformity (WTWNU).

The details of one or more implementations are set forth in the accompanying drawings and the description below. Other aspects, features and advantages will be apparent from the description and drawings, and from the claims.

BRIEF DESCRIPTION OF DRAWINGS

Like reference symbols in the various drawings indicate like elements.

DETAILED DESCRIPTION

CMP systems can use eddy current monitoring systems to detect thickness of a top metal layer on a substrate. During polishing of the top metal layer, the eddy current monitoring system can determine the thickness of different regions of the metal layer on the substrate. The thickness measurements can be used to trigger a polishing endpoint and/or to adjust processing parameters of the polishing process in real time. For example, a substrate carrier head can adjust the pressure on the backside of the substrate to increase or decrease the polishing rate of the regions of the metal layer. The polishing rate can be adjusted so that the regions of the metal layer are substantially the same thickness after polishing. The CMP system can adjust the polishing rate so that polishing of the regions of the metal layer completes at about the same time. Such profile control can be referred to as real time profile control (RTPC).

Some eddy current monitoring systems have an elongated core such that the monitoring system monitors an elongated region on the substrate. Such a monitoring system can provide improved signal strength at the substrate edge while maintaining high resolution at the substrate edge. In addition, an elongated region can reduce sensitivity to angular variations in thickness at the substrate edge. However, if the relative angle between the region and the substrate edge changes over time, e.g., due to sweep of the carrier head, significant noise can be introduced into the portion of the signal generated by the monitoring system that corresponds to the substrate edge. By calculating the angle and feeding the data into a controller, this noise can be significantly reduced.

Figure 1:
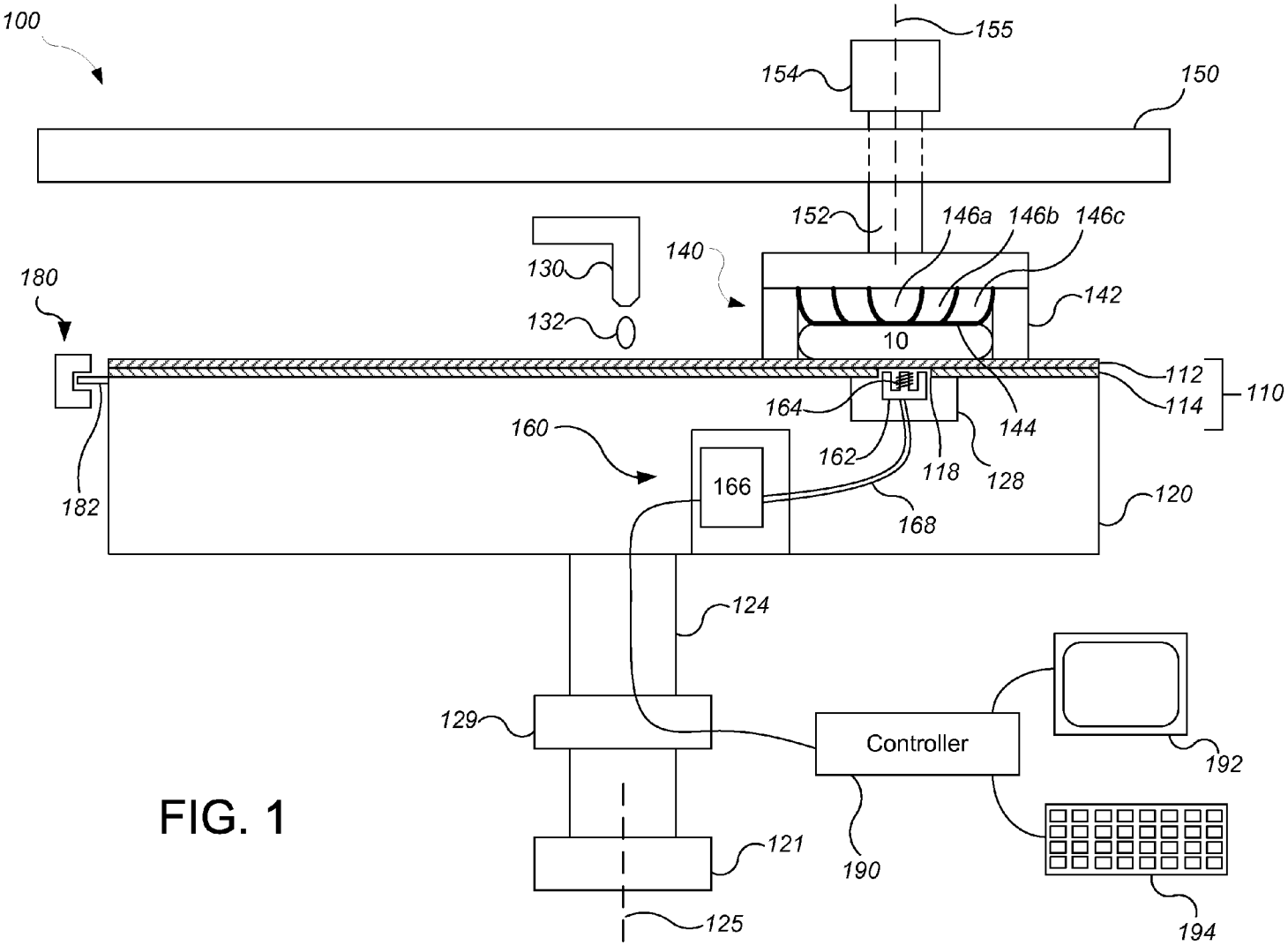
FIG. 1 is a schematic side view, partially cross-sectional, of a chemical mechanical polishing station that includes an eddy current monitoring system.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 124 to rotate the platen 120. The polishing pad 110 can be a two-layer polishing pad with an outer polishing layer 112 and a softer backing layer 114.

The polishing apparatus 100 can include a port 130 to dispense polishing liquid 132, such as slurry, onto the polishing pad 110. The polishing apparatus can also include a polishing pad conditioner to abrade the polishing pad 110 to maintain the polishing pad 110 in a consistent abrasive state.

The polishing apparatus 100 includes at least one carrier head 140. The carrier head 140 is operable to hold a substrate 10 against the polishing pad 110. The carrier head 140 can have independent control of the polishing parameters, for example pressure, associated with each respective substrate.

In particular, the carrier head 140 can include a retaining ring 142 to retain the substrate 10 below a flexible membrane 144. The carrier head 140 also includes a plurality of independently controllable pressurizable chambers defined by the membrane, e.g., three chambers 146*a*-146*c*, which can apply independently controllable pressures to associated zones on the flexible membrane 144 and thus on the substrate 10. Although only three chambers are illustrated in FIG. 1 for ease of illustration, there could be one or two chambers, or four or more chambers, e.g., five chambers.

The carrier head 140 is suspended from a support structure 150, e.g., a carousel or a track, and is connected by a drive shaft 152 to a carrier head rotation motor 154 so that the carrier head can rotate about an axis 155. Optionally the carrier head 140 can oscillate laterally, e.g., on sliders on the carousel 150 or track; or by rotational oscillation of the carousel itself. In operation, the platen is rotated about its central axis 125, and the carrier head is rotated about its central axis 155 and translated laterally across the top surface of the polishing pad.

While only one carrier head 140 is shown, more carrier heads can be provided to hold additional substrates so that the surface area of polishing pad 110 may be used efficiently.

The polishing apparatus also includes an in-situ monitoring system 160. The in-situ monitoring system generates a time-varying sequence of values that depend on the thickness of a layer on the substrate.

The in-situ-monitoring system 160 can be an eddy current monitoring system. The eddy current monitoring system 160 includes a drive system to induce eddy currents in a metal layer on the substrate and a sensing system to detect eddy currents induced in the metal layer by the drive system. The monitoring system 160 includes a core 162 positioned in a recess 128 to rotate with the platen, at least one coil 164 wound around a portion of the core 162, and drive and sense circuitry 166 connected by wiring 168 to the coil 164. In some implementations, the core 162 projects above the top surface of the platen 120, e.g., into a recess 118 in the bottom of the polishing pad 110.

The drive and sense circuitry 166 is configured to apply an oscillating electric signal to the coil 164 and to measure the resulting eddy current. A variety of configurations are possible for the drive and sense circuitry and for the configuration and position of the coil(s), e.g., as described in U.S. Pat. Nos. 6,924,641, 7,112,960 and 8,284,560, and in U.S. Patent Publication Nos. 2011-0189925 and 2012-0276661, each of which is incorporated by reference. The drive and sense circuitry 166 can be located in the same recess 128 or a different portion of the platen 120, or could be located outside the platen 120 and be coupled to the components in the platen through a rotary electrical union 129.

In operation the drive and sense circuitry 166 drives the coil 164 to generate an oscillating magnetic field. At least a portion of magnetic field extends through the polishing pad 110 and into substrate 10. If a metal layer is present on substrate 10, the oscillating magnetic field generates eddy currents in the metal layer. The eddy currents cause the metal layer to act as an impedance source that is coupled to the drive and sense circuitry 166. As the thickness of the metal layer changes, the impedance changes, and this can be detected by the drive and sense circuitry 166.

Optionally an optical monitoring system, which can function as a reflectometer or interferometer, can be secured to the platen 120 in the recess 128 to monitor the same portion of the substrate being monitored by the eddy current monitoring system 160.

The CMP apparatus 100 can also include a position sensor 180, such as an optical interrupter, to sense when the core 162 is beneath the substrate 10. For example, the optical interrupter could be mounted at a fixed point opposite the carrier head 140. A flag 182 is attached to the periphery of the platen. The point of attachment and length of flag 182 is selected so that it interrupts the optical signal of sensor 180 while the core 164 sweeps beneath substrate 10. Alternately or in addition, the CMP apparatus can include an encoder to determine the angular position of platen.

A controller 190, such as a general purpose programmable digital computer, receives the intensity signals from the eddy current sensing system 160. The computer 190 can include a processor, memory, and I/O devices, as well as an output device 192 e.g., a monitor, and an input device 194, e.g., a keyboard.

The signals can pass from the eddy current monitoring system 160 to the controller 190 through the rotary coupler 129. Alternatively, the circuitry 166 could communicate with the controller 190 by a wireless signal.

Since the core 164 sweeps beneath the substrate with each rotation of the platen, information on the metal layer thickness is accumulated in-situ and on a continuous real-time basis (once per platen rotation). The computer 190 can be programmed to sample measurements from the monitoring system when the substrate generally overlies the core 164 (as determined by the position sensor). As polishing progresses, the thickness of the metal layer changes, and the sampled signals vary with time. The time varying sampled signals may be referred to as traces. The measurements from the monitoring systems can be displayed on the output device 192 during polishing to permit the operator of the device to visually monitor the progress of the polishing operation.

In operation, the CMP apparatus 100 can use the eddy current monitoring system 160 to determine when the bulk of the filler layer has been removed and/or to determine when the underlying stop layer has been substantially exposed. Possible process control and endpoint criteria for the detector logic include local minima or maxima, changes in slope, threshold values in amplitude or slope, or combinations thereof.

The controller 190 may also be connected to the pressure mechanisms that control the pressure applied by carrier head 140, to carrier head rotation motor 154 to control the carrier head rotation rate, to the platen rotation motor 121 to control the platen rotation rate, or to slurry distribution system 130 to control the slurry composition supplied to the polishing pad. In addition, the computer 190 can be programmed to divide the measurements from the eddy current monitoring system 160 from each sweep beneath the substrate into a plurality of sampling zones, to calculate the radial position of each sampling zone, and to sort the amplitude measurements into radial ranges, as discussed in U.S. Pat. No. 6,399,501, the entirety of which is incorporated herein by reference. After sorting the measurements into radial ranges, information on the film thickness can be fed in real-time into a closed-loop controller to periodically or continuously modify the polishing pressure profile applied by a carrier head in order to provide improved polishing uniformity.

Figure 2A:
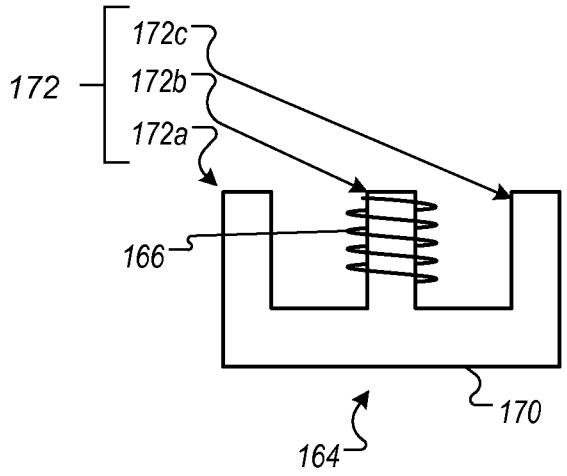
FIGS. 2A and 2B show side and perspective views of an eddy current monitoring system with three prongs.
Figure 2B:
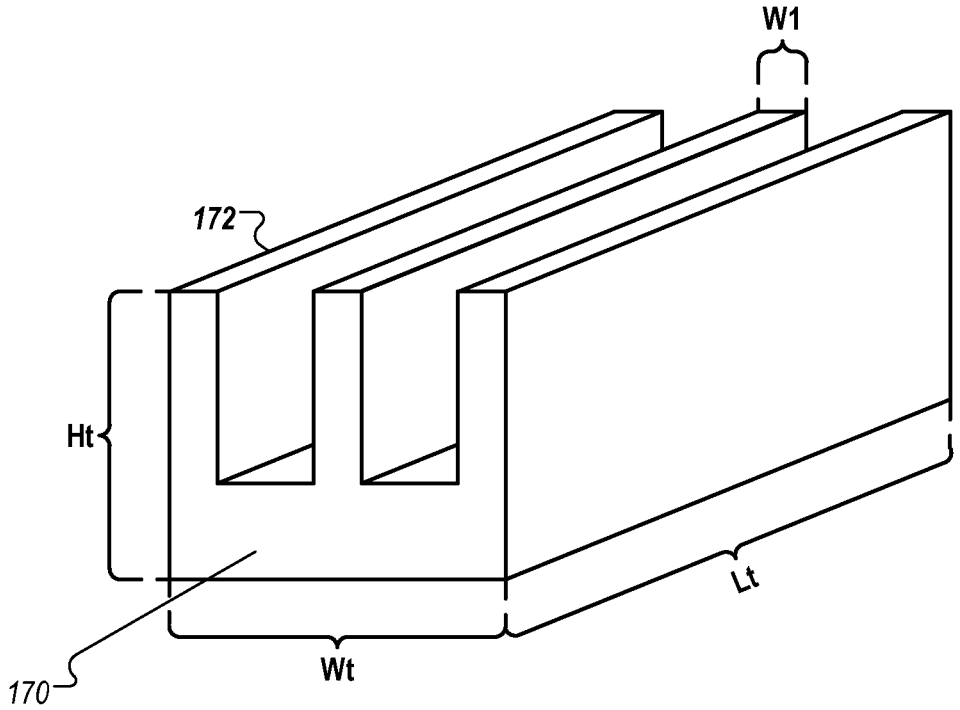

FIGS. 2A and 2B show an example of a core 164 from the eddy current monitoring system 160. The core 164 is formed of a non-conductive material with a relatively high magnetic permeability (e.g., $\mu$ of about 2500 or more). The core 164 can be coated with a water repellant material. For example, the core 164 can be coated with a material such as parylene to prevent water from entering pores in the core 164, and to prevent coil shorting.

The core 164 is elongated, with a length Lt along the primary axis of the core 164 greater than its width Wt along a secondary axis perpendicular to the primary axis. When the core is installed in the platen, both the primary axis and secondary axis are parallel to the surface of the platen 120, e.g., parallel to the faces of the substrate and polishing pad during the polishing operation. The elongated structure of the core causes the region measured on the substrate to be similarly elongated. The core 164 can include one or more prongs 172; when installed in the platen the prongs 172 project perpendicular to the plane of the platen, e.g., vertically.

In some implementations, the core 164 has an E-shaped cross-section in the plane perpendicular to the primary axis. The core 164 can include a back portion 170 and three prongs 172*a*-172*c* extending from the back portion 170. The prongs extend away from the back portion 170 along a third axis that is perpendicular to both the primary axis and secondary axis. In addition, the prongs 172*a*-172*c* are substantially linear and extend in parallel to each other and along the primary axis. The prongs are spaced apart from each other in the secondary axis. Each prong can have a length Lt along the primary axis that is greater than its width W1 along the secondary axis. The two outer prongs 172*a*, 172*c* are on opposite sides of the middle prong 172*b*. The outer prongs 172*a*, 172*c* can be equidistant from the middle prong 172*b*.

Figure 3:
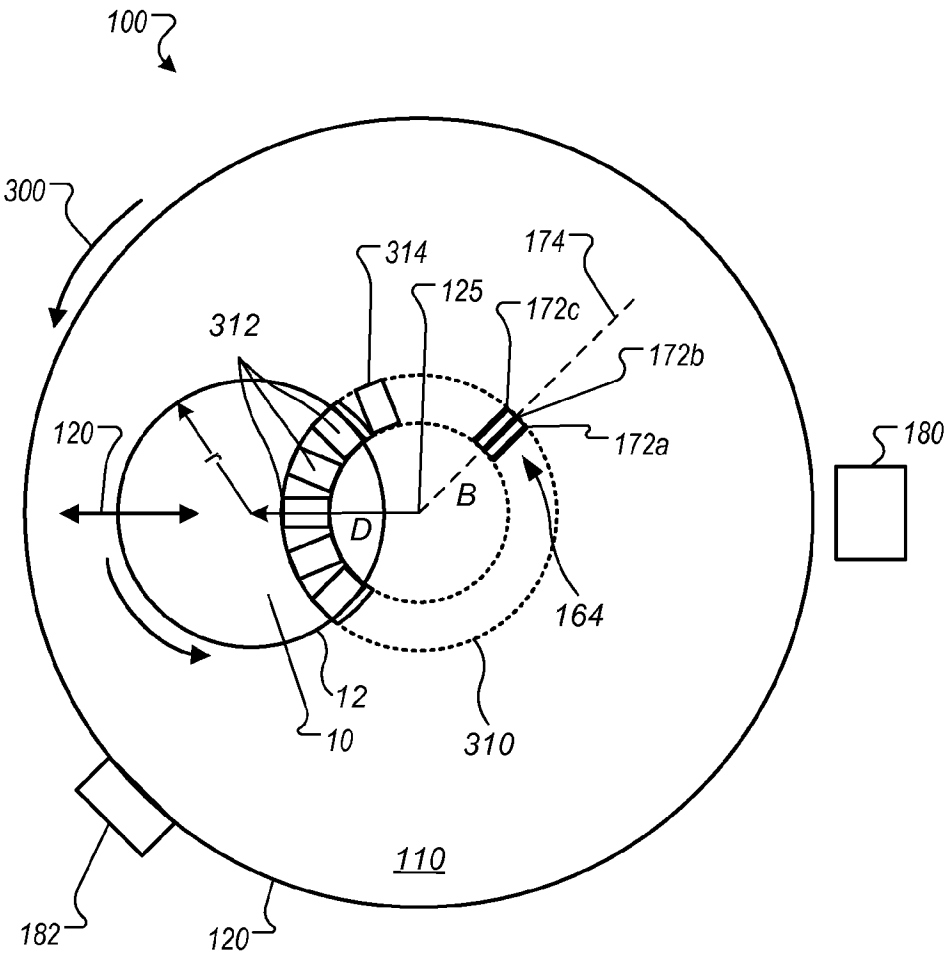
FIG. 3 shows a top view of a chemical mechanical polishing station.

FIG. 3 shows the CMP system 100 with the elongated core 164 as part of the eddy current monitoring system. In some implementations, the elongated core 164 can be oriented so that the primary axis 174 passes through the axis of rotation 125 of the platen. As the platen 120 rotates (shown by arrow 300), the core 164 will traverse a circular path 310, a portion of which passes below the substrate 10. As the core 164 passes below the substrate 10, the eddy current monitoring system can take measurements at a sequence of positions 312 along the path 310. At each position 312, the monitoring system monitors an elongated region on the substrate. Although only five positions 312 are illustrated in FIG. 3, the sampling rate could be much higher, e.g., measurements could be taken at hundreds of positions. In addition, although FIG. 3 illustrates the regions as non-overlapping, if the positions are sufficiently close together then the measured regions could partially overlap.

Figure 4A:
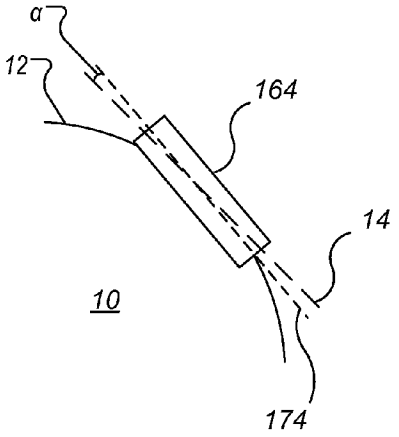
FIGS. 4A and 4B are schematic views of a core of the eddy current monitoring system passing below an edge of a substrate.

As shown in FIG. 4A, the elongated core 164 can be oriented in the platen 120 such that, for at least some lateral positions of the substrate 10, when the core 164 is positioned immediately below the edge 12 of the substrate 10, e.g., the center of the core 164 coincides with the substrate edge, the primary axis 174 of the core 164 forms an angle $\alpha$ less than a critical angle, e.g., less than 15°, e.g., less than 5°. e.g., less than 1°, with the line 14 that is tangent to the substrate edge 12. That is, when the core 164 is at the position 314, the primary axis of the core 164 is approximately perpendicular to a radius r of the substrate 10 that passes through the center of the core 164. Therefore, for measurements near the substrate edge, the portion of the conductive layer on the substrate 10 that couples with the magnetic field produced by the coil is generally at the same radial distance from the center of the substrate. Consequently, the monitoring system can provide improved signal strength at the substrate edge without significant loss of resolution at the substrate edge.

Figure 4B:
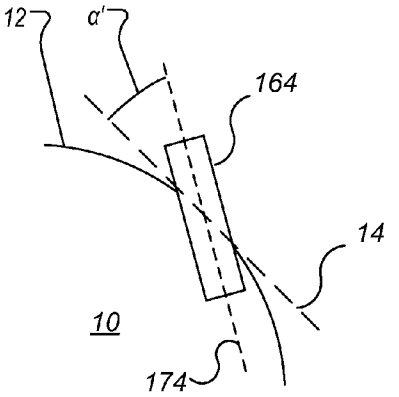

If the carrier head 140 is laterally fixed during polishing, then the angle α will remain constant during the polishing operation. However, for some polishing operations, the carrier head sweeps laterally, changing its relative distance D (see FIG. 3) from the axis of rotation 125 of the platen 120. Comparing FIGS. 4A and 4B, this causes the relative angle α between the region and the substrate edge 12 to change over time, so that the angle α will be different for different sweeps of the core 164 below the substrate 10.

Figure 5A:
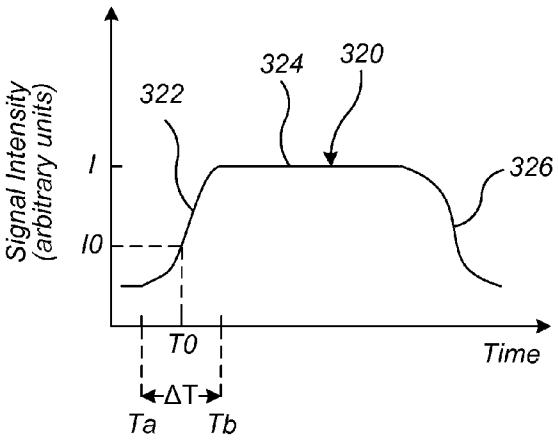
FIGS. 5A and 5B are schematic graphs of a signal from the eddy current monitoring system.
Figure 5B:
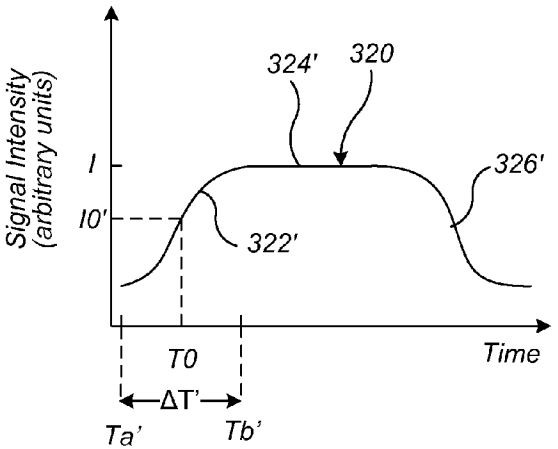

Referring to FIGS. 5A and 5B, this change in angle α can result in a change in the signal from the eddy current monitoring system 160. FIG. 5A illustrates a signal 320 from the eddy current monitoring system 160 during a single pass of the core 164 below the substrate 10. The signal includes a first time period 322 that corresponds to the time during which the measurement region passes across the leading edge of the substrate 10, a second time period 324 that corresponds to the time during which the measurement region scans across the substrate 10, and a third time period 326 that corresponds to the time during which the measurement region passes across the trailing edge of the substrate 10. The first time period 322 and the third time period 326 are referred to as edge time periods.

In the first time period 322, the signal intensity ramps up from an initial intensity (typically the signal resulting when no substrate and no carrier head is present) to an intensity I. This is caused by the transition of the monitoring region from initially only slightly overlapping the substrate (generating the initial lower values) to the monitoring region nearly entirely overlapping the substrate (generating the higher values). As shown in FIG. 5A, this transition can occur over a time period from Ta to Tb, with a duration ΔT. Similarly, during the third time period 326, the signal intensity ramps down.

Although the second time period 324 is illustrated a flat, this is for simplicity, and a real signal in the second time period 324 would likely include fluctuations due both to noise and to variations in the metal layer thickness.

As shown FIG. 5B, if the angle α increases (compare FIGS. 4A and 4B), and assuming that the rotation rate of the platen is the same, it will take a longer time αT' for the monitoring region to transition from only slightly overlapping the substrate to nearly entirely overlapping the substrate. Consequently, the slope of the signal during the first time period 322' and the last time period 326' will be lower. Conversely, if the angle α decreases, the time ΔT' is smaller and the slope of the signal during the first time period 322' is greater.

In addition, the change in the angle α can cause variations in sensitivity or gain. Even if the layer thickness is the same, if the angle α changes, the signal at the midpoint T0 of the edge time period can change (T0 should be the time at which the center of the core is aligned with the substrate edge 12). In particular, in the case of an eddy current monitoring system having the prong configuration and orientation illustrated in FIGS. 2A, 2B, and 3, as the angle α increases, the gain of the monitoring system increases for positions of the core 164 near the substrate edge 12. Thus, as shown in FIGS. 5A and 5B, if the angle α' increases, the signal at the midpoint T0 can increase from I0 to I0'. The gain levels off as the core 164 moves further below the substrate 10, so that by the time the core 164 is completely below the substrate 10, the same signal intensity I should result regardless of the angle α. Without being limited to any particular theory, the change in gain can be caused by the anisotropic magnetic field lines generated by the core 164.

This variation in the shape of the signal 320 can cause errors in the calculating of a characterizing value for the substrate, e.g., the thickness, near the substrate edge. To compensate for this, the angle α can be fed into an edge reconstruction algorithm. The edge reconstruction algorithm can compensates for the variances caused by sweep-to-sweep variances in the angle α.

The angle α can be calculated from the distance D between the axis of rotation 125 of the platen 120 and the center of the substrate 10 (which can be measured by an linear encoder that measures the sweep of the carrier head 140), the radius r of the substrate 10 (which can be input by a user), the distance B between the axis of rotation 125 of the platen 120 and the center of the core 164 (which can be input by a user), and the angle β, if any, between the primary axis 174 and a line that passes through the axis of rotation 125 and the core 164.

For example, the angle α at the time that the center of core coincides with the substrate edge can be calculated as $$\alpha = \cos^{-1}\frac{D^2 - r^2 - B^2}{2rB} + \beta - 90^\circ$$

Each intensity measurement fed into the edge reconstruction algorithm can be accompanied by a calculated angle α.

The edge reconstruction algorithm can find the start and end times of the first time portion 322, i.e., Ta and Tb, and the start and end times of third time portion 326 of the signal. For example, the controller 190 can calculate a derivative of the intensity signal 320 and identify the regions with slope above a threshold. The edge reconstruction algorithm can also limit evaluation of the signal 320 based on input from the position detector 180. For example, evaluation can be limited to portions of the signal 320 within a threshold time of a time that the position sensor 180 indicates that the core 164 is passing below the substrate edge 12.

The angle α for the first time portion 322 and third time portion 326 can be determined. For example, the angle α for the each time portion can be calculated as an average of the angles α associated with the intensity measurements received within that time portion. Alternatively, the angle α at a time that the position sensor 180 indicates that the platen is at a particular angular orientation could be used.

Once an angle α has been established for the time portion, a reconstructed edge signal can be calculated. The reconstructed edge signal at least partially compensates for the variation in the angle α from rotation to rotation of the platen 120.

In some implementations, the edge time portions are compressed or decompressed. For example, referring to FIG. 6, the initial signal 320 can have a first time period 322 that extends from time Ta to time Tb. If the angle α is larger than a threshold angle, the portion of the signal in the edge time periods 322, 326 can be time-compressed to generate a modified signal 330. As shown, in the modified signal 330, due to the compression the duration of the edge time periods 322, 326 has been reduced and the slope of the signal in the edge time periods 322, 326 is increased. The amount of compression, e.g., the ratio ΔT/ΔTm can be a function of the angle α, e.g., be proportional to the angle α.

In some implementations, which can be combined with the compression or decompression, the intensity of the edge time portions (and optionally also the center time portion 324) is adjusted. For example, intensity values in the initial signal 320 during the edge time periods 322, 326 can be divided (or multiplied) by a gain factor to generate the modified signal 330. In general, the gain factor is calculated to compensate for the change in sensitivity of the monitoring system that depends on the angle α.

Figure 6:
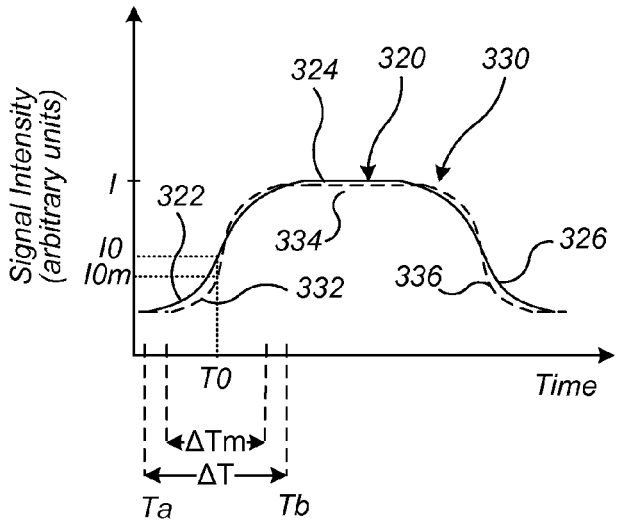
FIG. 6 illustrates a modification of a signal from the eddy current monitoring system.

As noted above, in general, at a higher angle α, the eddy current monitoring system 160 can be more sensitive. The gain factor can be a function of the angle α. Assuming the initial signal is multiplied by the gain factor, the gain factor can decrease as the angle α increases. In addition, the gain factor can be a function of time within the edge time period. Again assuming the initial signal is multiplied by the gain factor, the gain factor can decrease as the time distance from the center time period 334 increases. For example, as shown in FIG. 6, in the modified signal 330, due to multiplication by the gain factor, the intensity at the midpoint T0 of the edge time periods 322 has been reduced from I0 to I0*m*. The gain factor can be calculated using an algebraic function of the angle α and the time, or using a look up table.

Due to this compensation, the effect of variation of the angle α between the elongated monitoring region and the substrate edge can be significantly reduced, making calculation of the characterizing value more accurate, and thus improving endpoint control and/or closed-loop control of polishing parameters to give better within-wafer non-uniformity (WIWNU) and water -to-wafer non-uniformity (WTWNU).

Figure 7:
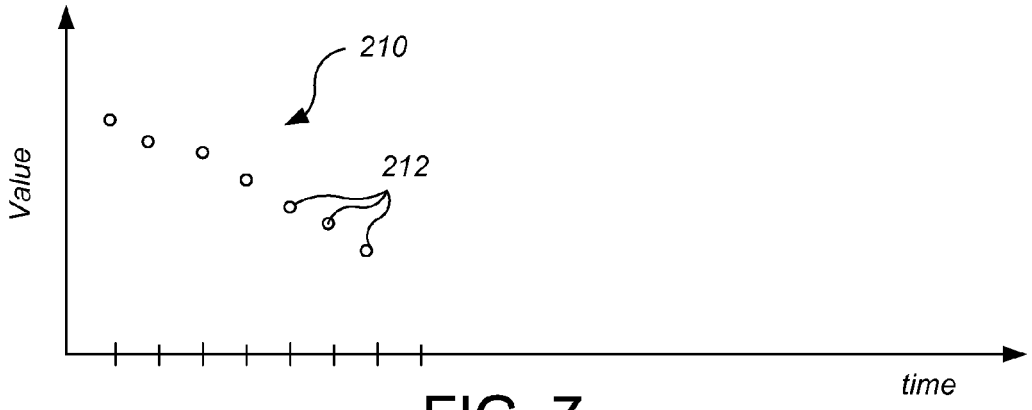
FIG. 7 illustrates a time-varying sequence of characterizing values generated from the signal from the monitoring system.

Referring to FIG. 7, which illustrates the results for only a single zone of a substrate, a time-varying sequence of characterizing values 212 is illustrated. The characterizing values 212 are generated from the signal 320 from the monitoring system 160. This sequence of values can be termed a trace 210. In general, for a polishing system with a rotating platen, the trace 210 can include one, e.g., exactly one, value per sweep of the sensor of the optical monitoring system below the substrate. If multiple zones on a substrate are being monitored, then there can be one value per sweep per zone. For a zone at the substrate edge 12, the characterizing values 212 can be determined based on the modified edge portion 332, 336 of the signal 320. Multiple measurements within a zone can be combined to generate a single value that is used for control of the endpoint and/or pressure.

Figure 8:
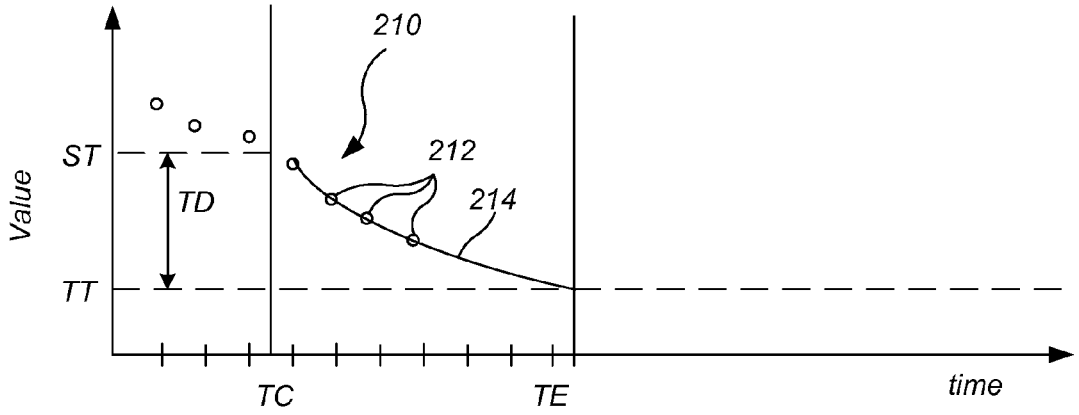
FIG. 8 illustrates fitting a function to the time-varying sequence of characterizing values.

Prior to commencement of the polishing operation, the user or the equipment manufacturer can define a function 214 that will be fit to the time-varying sequence of values 212. For example, the function can be a polynomial function, e.g., a linear function. As shown in FIG. 8, the function 214 is fit to the sequence of values 212. Multiple techniques exist to fit generalized functions to data. For linear functions such as polynomials, a general linear least squares approach can be employed.

Optionally, the function 214 can be fit to the values collected after time TC. Values collected before the time TC can be ignored when fitting the function to the sequence of values. For example, this can assist in elimination of noise in the measured spectra that can occur early in the polishing process, or it can remove spectra measured during polishing of another layer. Polishing can be halted at an endpoint time TE that the function 214 equals a target value TT.

The monitoring system can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there can be a fluid bearing between the platen and polishing pad during polishing. The polishing pad can be a standard (e.g., polyurethane with or without fillers) rough pad, a soft pad, or a fixed-abrasive pad.

Although the discussion above focuses on an eddy current monitoring system, the correction techniques can be applied to other sorts of monitoring systems, e.g., optical monitoring systems, that monitor an elongated region on the substrate. In addition, although the discussion above focuses on a monitoring system with an elongated monitoring region, the correction techniques can be applied even if the monitoring region is not elongated but an anisotropic sensor generates a signal that depends on the relative orientation of the sensor to the substrate edge.

A number of embodiments of the invention have been described. Nevertheless, it will be understood that various modifications may be made without departing from the spirit and scope of the invention. Accordingly, other embodiments are within the scope of the following claims.

What is claimed is:

1. A method of chemical mechanical polishing a substrate, comprising:

polishing a layer on the substrate at a polishing station;

monitoring the layer during polishing at the polishing station with an in-situ monitoring system, the in-situ monitoring system monitoring an elongated region and generating a measured signal;

computing an angle between a primary axis of the elongated region and a tangent to an edge of the substrate;

modifying the measured signal based on the angle to generate a modified signal; and at least one of detecting a polishing endpoint or modifying a polishing parameter based on the modified signal.

2. A method of chemical mechanical polishing a substrate, comprising:

polishing a layer on the substrate at a polishing station;

monitoring the layer during polishing at the polishing station with an in-situ monitoring system, the in-situ monitoring system including a sensor having a primary axis parallel to the layer on the substrate and generating a measured signal that depends on a thickness of the layer on the substrate and on an orientation of the primary axis relative to the substrate;

computing an angle between a primary axis of the sensor and a tangent to an edge of the substrate; and modifying the measured signal based on the angle to generate a modified signal; and at least one of detecting a polishing endpoint or modifying a polishing parameter based on the modified signal.

3. The method of claim 2, wherein the angle comprises the angle at a time when the sensor is adjacent the edge of the substrate.

4. The method of claim 3, comprising detecting edge portions of the measured signal.

5. The method of claim 4, wherein modifying the measured signal comprises compressing or decompressing the edge portions.

6. The method of claim 5, wherein a compression ratio from the compressing or decompressing is a function of the angle.

7. The method of claim 6, wherein the function of the angle is such that the compression ratio increases as the angle increases.

8. The method of claim 3, wherein modifying the measured signal comprises multiplying the measured signal by a gain factor.

9. The method of claim 8, wherein the gain factor is a function of the angle such that the gain factor decreases as the angle increases.

10. The method of claim 2, wherein the in-situ monitoring system comprises an eddy current monitoring system having an elongated core.

11. A polishing system, comprising:

a carrier to hold a substrate;

a support for a polishing surface;

an in-situ monitoring system having a sensor, the in-situ monitoring system configured to monitor an elongated region and generate a measured signal;

a motor to generate relative motion between the sensor and the substrate; and a controller configured to receive the measured signal from the in-situ monitoring system, compute an angle between a primary axis of the elongated region and a tangent to an edge of the substrate, modify the measured signal based on the angle to generate a modified signal, and at least one of detect a polishing endpoint or modify a polishing parameter based on the modified signal.

12. A polishing system, comprising:

a carrier to hold a substrate;

a support for a polishing surface;

an in-situ monitoring system having a sensor having a primary axis parallel to a layer on the substrate, the sensor configured to generate a measured signal that depends on a thickness of the layer and on an orientation of the primary axis relative to the substrate;

a motor to generate relative motion between the sensor and the substrate; and a controller configured to receive the measured signal from the in-situ monitoring system, compute an angle between the primary axis of the sensor and a tangent to an edge of the substrate, modify the measured signal based on the angle to generate a modified signal, and at least one of detect a polishing endpoint or modify a polishing parameter based on the modified signal.

13. The system of claim 12, wherein the sensor is configured to monitor an elongated region of the substrate.

14. The system of claim 13, wherein the in-situ monitoring system comprises an eddy current monitoring system having an elongated core.

15. The system of claim 12, wherein the sensor is configured to monitor a region of the substrate that is not elongated.

16. The system of claim 12, wherein the controller is configured to compute the angle using the angle at a time when the sensor is adjacent the edge of the substrate.

17. The system of claim 12, wherein the controller is configured to detect edge portions of the measured signal that correspond to the edge of the substrate.

18. The system of claim 17, wherein the controller is configure to modify the measured signal by compressing or decompressing the edge portions.

19. The system of claim 18, wherein a compression ratio from the compressing or decompressing is a function of the angle.

* * * * *